US005343008A

United States Patent [19]

Ipcinski

[11] Patent Number: 5,343,008

[45] Date of Patent: Aug. 30, 1994

[54] SEALED SWITCH

[76] Inventor: Ralph G. Ipcinski, 295 Silver Lake Rd., Hollis, N.H. 03049

[21] Appl. No.: 73,270

[22] Filed: Jun. 7, 1993

Related U.S. Application Data

[63] Continuation of Ser. No. 837,147, Feb. 19, 1992, abandoned.

[51] Int. Cl.[5] ..... H01H 13/06

[52] U.S. Cl. ..... 200/302.002; 200/303; 200/333; 200/341; 200/520; 200/329

[58] Field of Search ..... 200/302.2, 303, 333, 200/341, 512, 516, 520, 521, 329

[56] References Cited

U.S. PATENT DOCUMENTS 3,978,298 8/1976 Fukuda ..... 200/333
4,119,823 10/1978 Matsueda et al. ..... 200/333
4,794,215 12/1988 Sawada et al. ..... 200/302.2
5,032,698 7/1991 Satoh ..... 200/341
5,059,754 10/1991 Kaichi et al. ..... 200/341
5,201,409 4/1993 Martin et al. ..... 200/341

*Primary Examiner*—Henry J. Recla
*Assistant Examiner*—David J. Walczak

[57] ABSTRACT

This is two embodiments of a sealed switch, one embodiment of which utilizes a plastic film which abuts the upper surface of the support portion and covers the upper edges of the walls defining the base and which is trapped between the upper edges of the walls defining the base and the cover portion forming a seal.

The second embodiment utilizes a start button which comprises a disk like support which is formed of an elastomeric material that on assembly is trapped and squeezed between the upper edges of the walls defining the base and the cover portion forming a seal.

3 Claims, 6 Drawing Sheets

SEALED SWITCH

This is a continuation of co-pending application Ser. No. 07/837,147 filed on Feb. 2, 1992, now abandoned.

BACKGROUND OF THE INVENTION

This invention relates to switches and more specifically to sealed switches.

The first embodiment of the invention utilizes a plastic film which abuts the upper surface of the support portion and covers the upper edges of the walls defining the base. The plastic film is trapped between the upper edges of the walls defining the base and the cover portion forming a seal.

The second embodiment utilizes a start button 52 which comprises a disk like support which is formed of an elastomeric material that on assembly is trapped and squeezed between the upper edges of the walls defining the base and the cover portion forming a seal.

BRIEF DESCRIPTION OF THE DRAWINGS

Further details are explained below with the help of the example(s) illustrated in the attached drawings in which.

DESCRIPTION OF THE PREFERRED EMBODIMENTS

Figure 1:
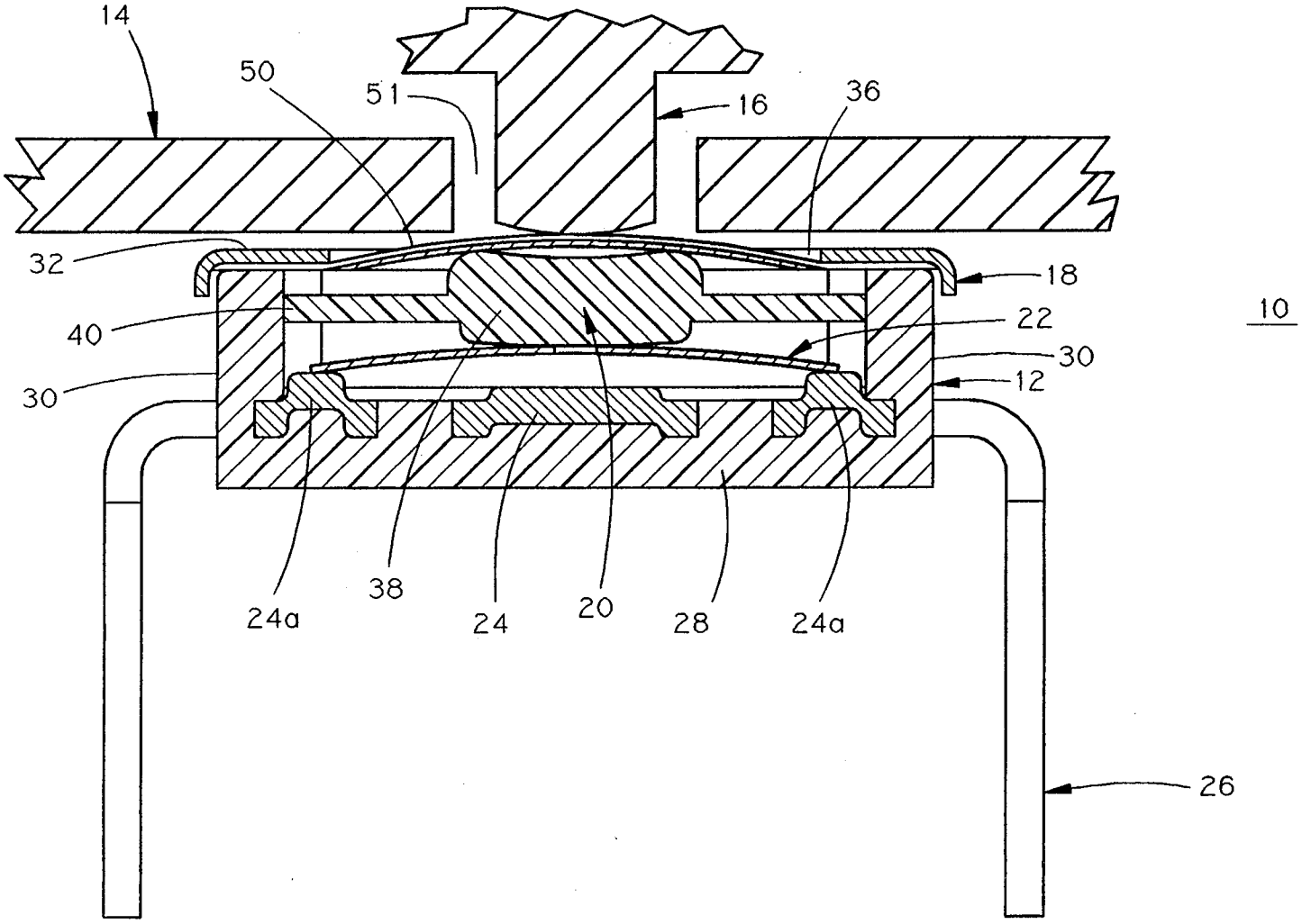
FIG. 1 is a section of the switch taken on line 1—1 of FIG. 2 according to the present invention.
Figure 2:
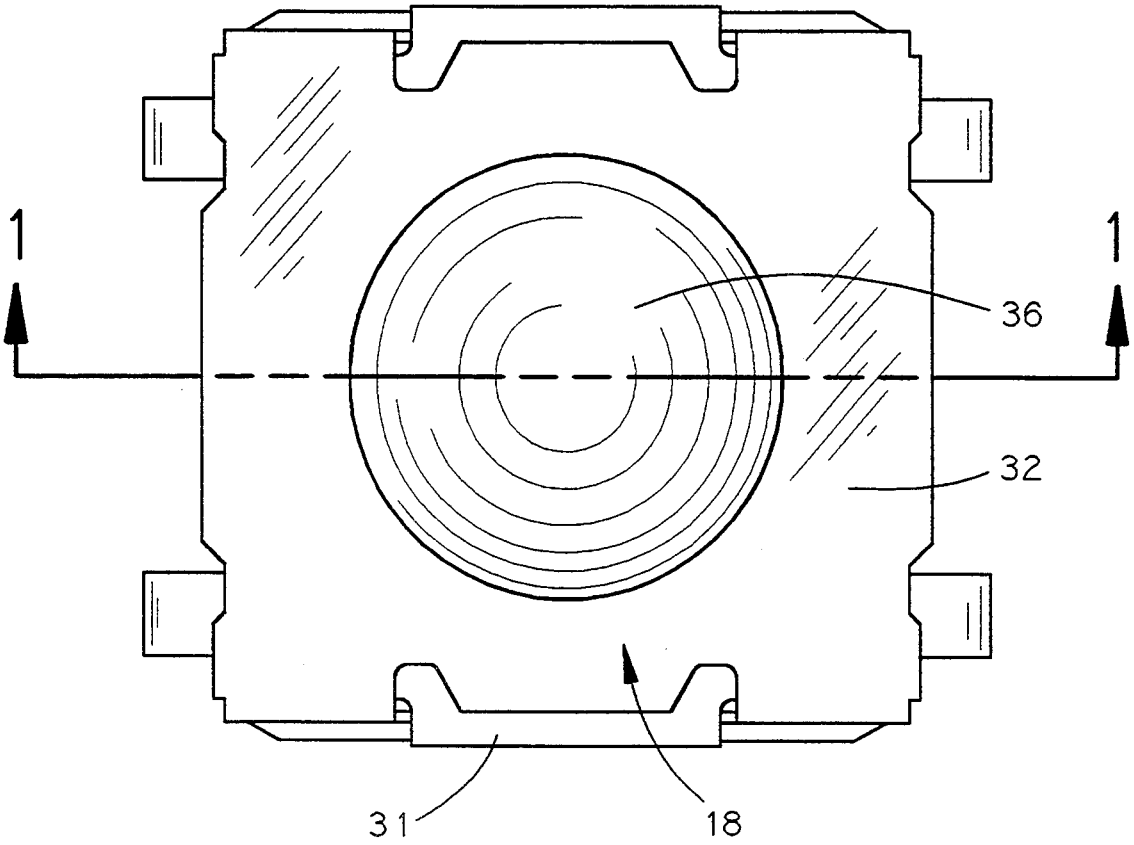
FIG. 2 is a top plan view of the switch shown in FIG. 1.

There is shown in the drawings at FIG. 1 a switch 10 comprising a base 12, a bezel or frame 14, an actuator 16, a cover portion 18, an secondary actuator 20, a movable contact 22, fixed contacts 24, **24*a* and terminals 26**.

Figure 3:
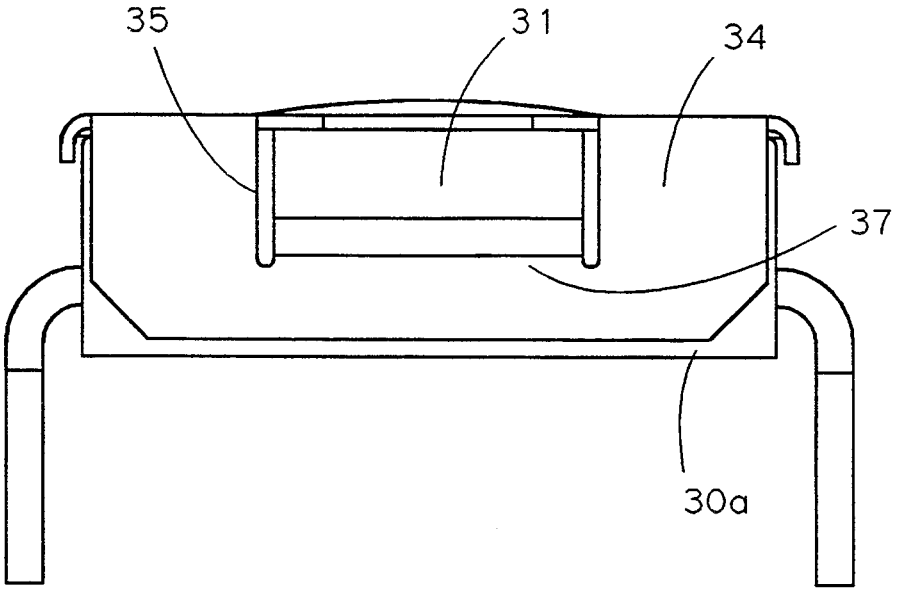
FIG. 3 is a side elevational view of the switch shown in FIG. 1.

The base 12 includes a rectangular base portion 28 having a pair of first peripheral edges and a pair of second peripheral edges. A first wall 30 extends from each first edge as shown in FIG. 1. A second wall **30*a* extends from each second edge as partially shown in FIG. 3. Each of the second walls 30*a* includes a centrally positioned projection 31. The base 12 is formed by insert molding around a metal stamping 33** as will be more fully set forth hereinafter.

The cover portion 18 is formed of metal comprising a square top portion 32 having an wing 34 extending integrally from two opposite sides thereof and an aperture 36 formed centrally through the top portion 32. Each of the wings 34 includes a centrally positioned, rectangular through opening 35 whose lower side provides an engagement bar 37.

The secondary,actuator 20 comprises a plastic support portion 38 which is centered in a disk 40. The support portion 38 comprises a pillow like construction having a concavo-convex configuration and the disk 40 circumscribes the support portion 38 as shown in FIG. 1.

Figure 4:
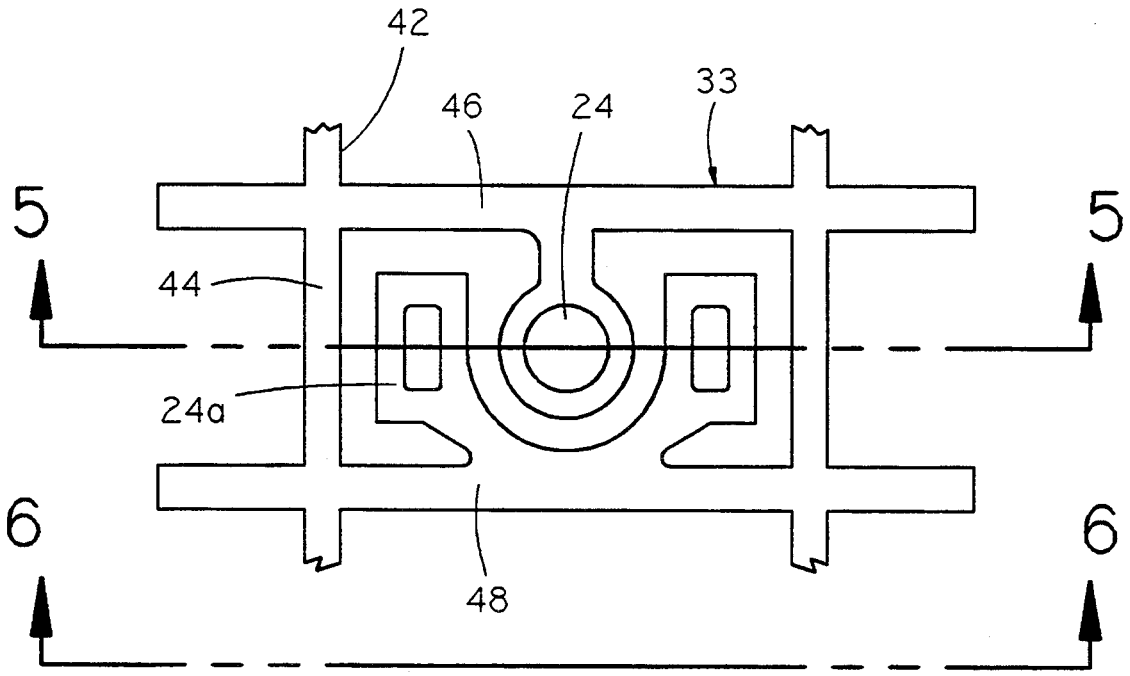
FIG. 4 is a top plan view of the metal stamping according to the present invention.
Figure 5:
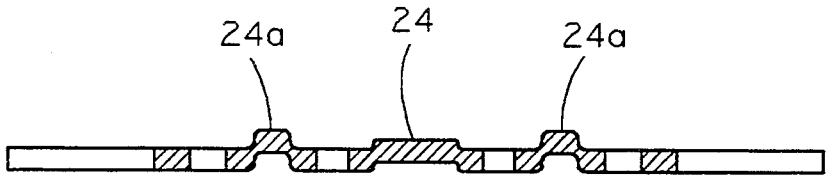
FIG. 5 is a sectional view of the metal stamping taken on line 5—5 of FIG. 4.
Figure 6:
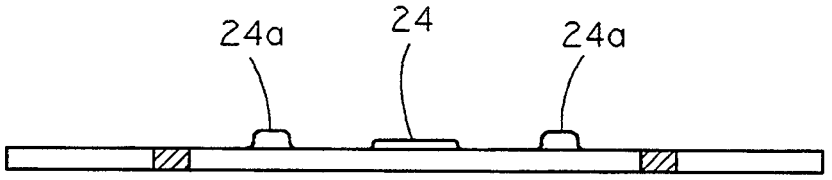
FIG. 6 is a sectional view partly in elevation of the metal stamping taken on line 6—6 of FIG. 4.
Figure 7:
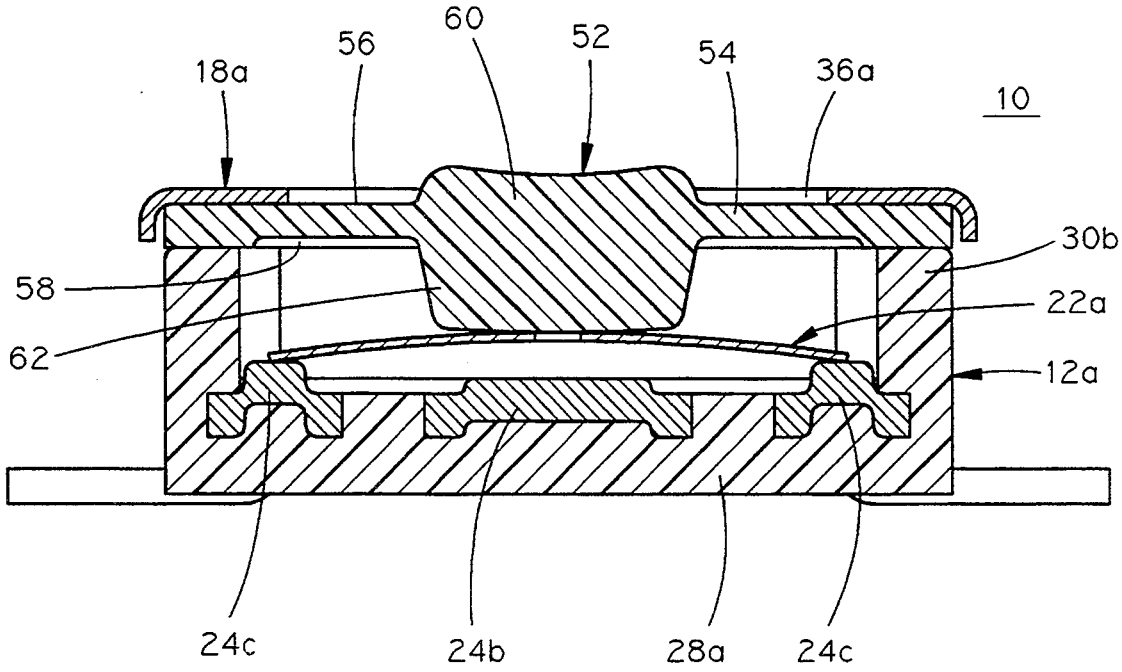
FIG. 7 is a section of a variation of the switch shown in FIG. 1 taken on line 7—7 of FIG. 8.

As shown in FIGS. 4–6 the metal stamping 33 comprising a series of the contact assemblies 42 attached to runners 44. The runners 44 are in spaced parallel relation to each other and in right angle relationship to the contact assemblies 42. Each of the contact assemblies 42 is in spaced parallel relation to other contact assemblies 42 (not shown). Each of the contact assemblies 42 includes a first terminal portion 46 which extends integrally from one runner 44 to the other runner 44 and which has a center fixed contact portion 24 extending integral therefrom as shown in FIG. 4. Each of the contact assemblies 42 also includes a second terminal portion 48 which extends integrally from one runner 44 to the other runner 44 and which has a pair of spaced secondary fixed contact portions **24*a* extending integral therefrom as shown in FIG. 4**.

The metal stamping 33 is positioned in an injection mold (not shown), for example, and the base 12 is formed around the metal stamping 33 during the molding process. After the insert molding process, the contact assembly 42 is separated from the runners 44 by a cutting process. The movable contact 22 is formed of a flexible current carrying material and is dish shaped.

The switch 10 is assembled, after formation of the subassembly of the metal stamping 33 and the base 12, by placing the movable contact 22 so that its peripheral edge rests on the fixed contacts **24*a* with the concave surface of the movable contact 22 spaced from and facing the central fixed contact 24. The support portion 38 of the actuator 20 is positioned on the arced portion of the movable contact 22 with the peripheral edge of the disk 40 in close proximity to the inside surface of the walls 30, 30*a*. A plastic film 50 abuts the upper surface of the support portion 38 and covers the upper edges of the walls 30, 30*a*. The cover portion 18 is positioned on top of the film 50 and each of the centrally positioned projections 31 is passed through the opening 35 and engaged by the engagement bar 37** to complete the assembly.

The frame 14 includes a through opening 51 having the actuator 16 movably mounted therein.

The switch is electrically connected to an electrical circuit (not shown), including a power source. If an operator applies pressure to the actuator 16, that pressure will be applied to the support portion 38 of the secondary actuator 20, which will compress slightly and bear against the movable contact 22 causing it to flex and to engage the central fixed contact 24 completing the electrical circuit.

A variation of the switch 10 is shown in FIG. 7–12 as the switch **10*a*. The switch 10*a* comprising a base 12*a*, a cover portion 18*a*, a start button 52, a movable contact 22*a*, fixed contacts 24*b*, 24*c* and terminals 26*a***.

Figure 8:
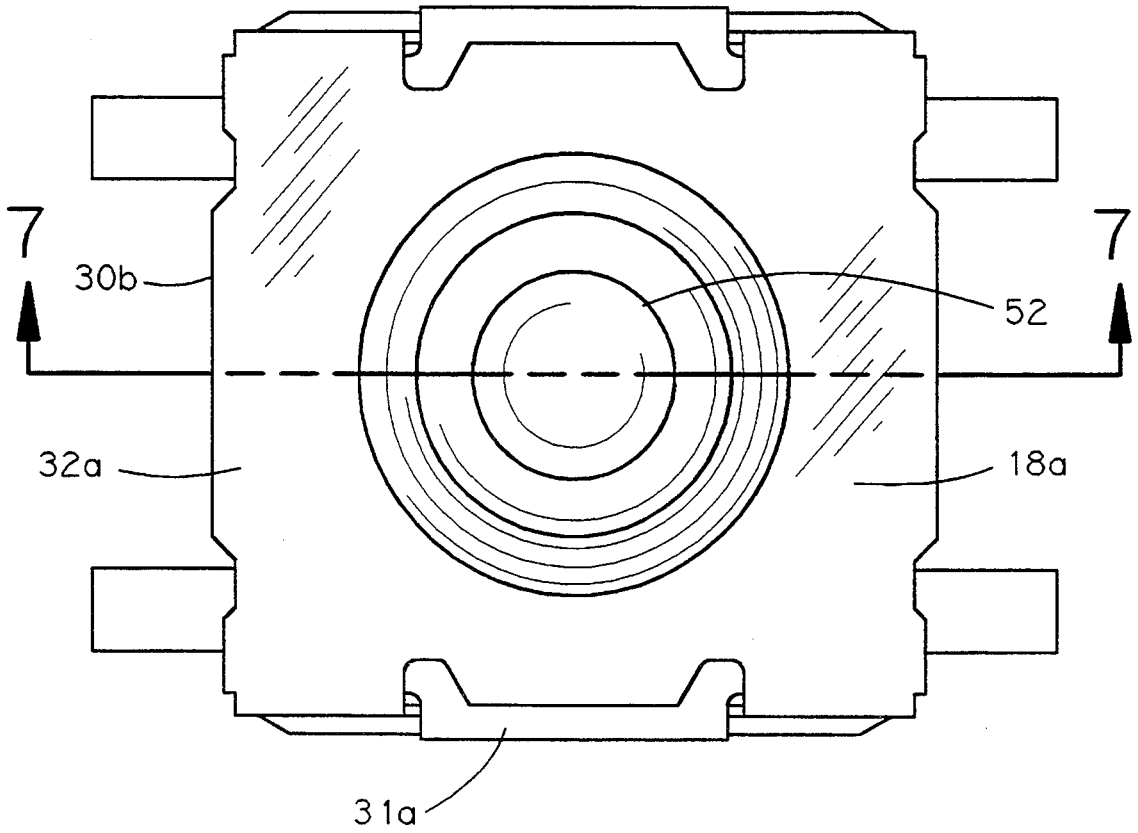
FIG. 8 is a top plan view of the switch shown in FIG. 7.
Figure 9:
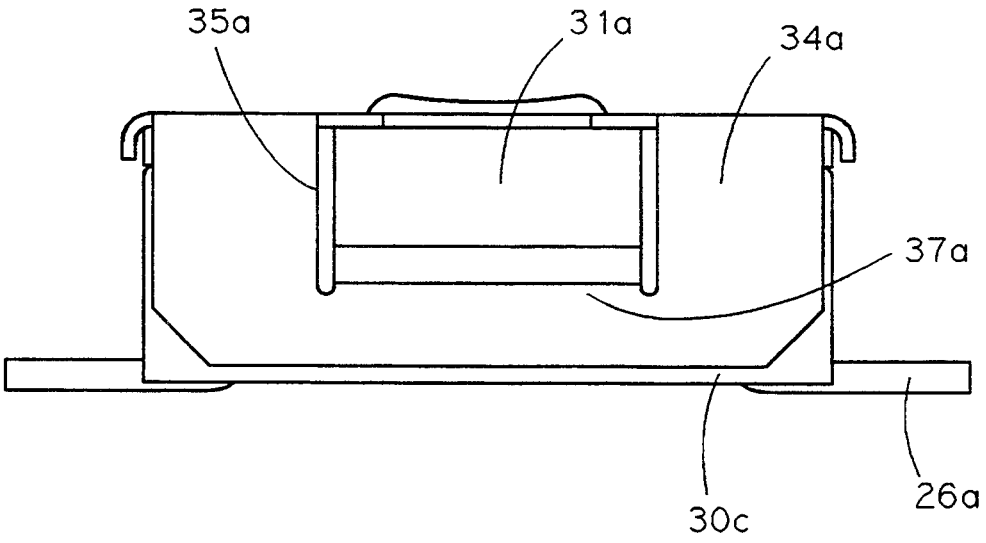
FIG. 9 is a side elevational view of the switch shown in FIG. 7.
Figure 10:
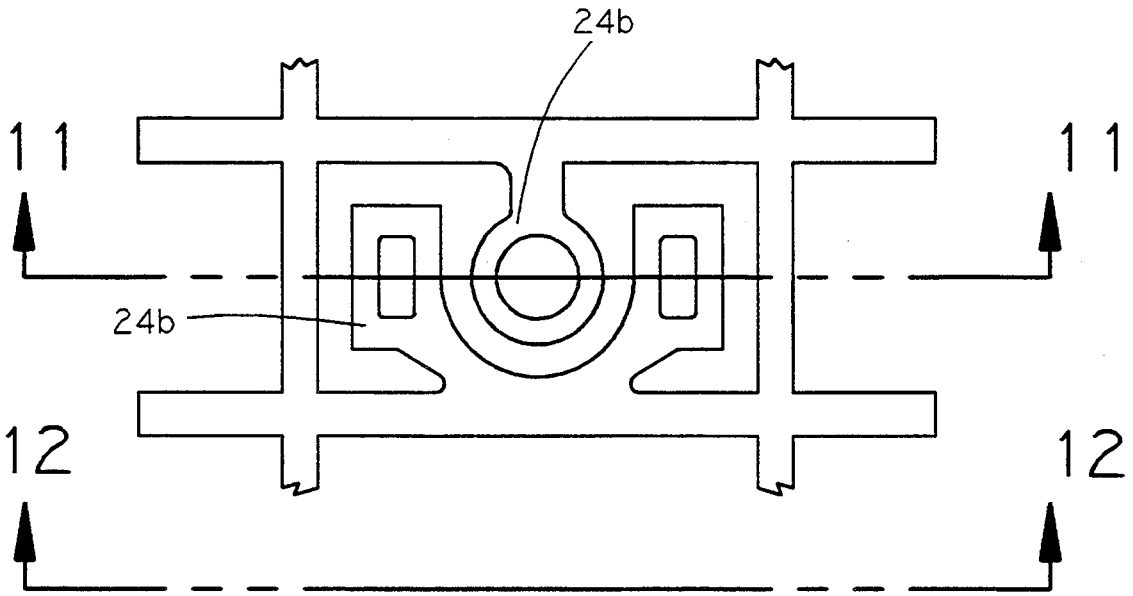
FIG. 10 is a top plan view of the metal stamping according to the present invention used with the variation shown in FIG. 8.
Figure 11:
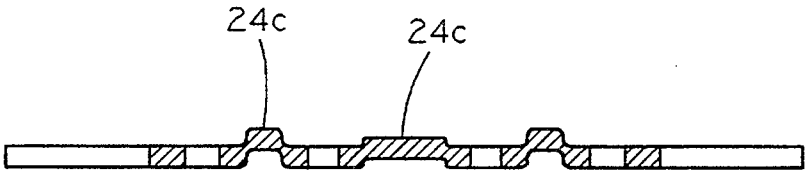
FIG. 11 is a sectional view of the metal stamping taken on line 11—11 of FIG. 10.
Figure 12:
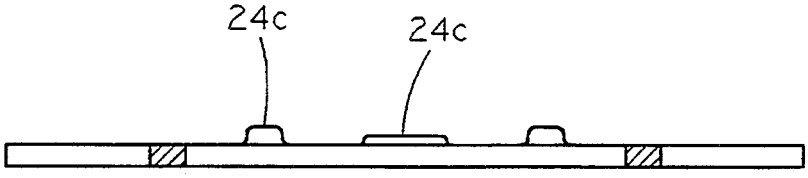
FIG. 12 is a sectional view partly in elevation of the metal stamping taken on line 12—12 of FIG. 10.

The base **12*a* includes a rectangular base portion 28*a* having a pair of first peripheral edges and a pair of second peripheral edges. A first wall 30b extends from each first edge as shown in FIG. 8. A second wall 30c extends from each second edge as partially shown in FIG. 9. Each of the second walls 30c includes a centrally positioned projection 31a**.

The subassembly of the metal stamping 33a and the base 12a is identical with the subassembly of the metal stamping 33 and the base 12.

The cover portion 18a is formed of metal comprising a square top portion 32a having an wing 34a extending integrally from two opposite sides thereof and an aperture 36a formed centrally through the top portion 32a. Each of the wings 34a includes a centrally positioned, rectangular through opening 35a whose lower side provides an engagement bar 37a.

The start button 52 of the switch 10a comprises a disk like support 54 having an upper surface 56 and a lower surface 58 and is formed of an elastomeric material. An activation portion 60 extends integrally from the center of the upper surface 56 of the support 54. The top surface of the activation portion 60 includes a depression. A bearing portion 62 extends integrally from the center of the lower surface 58 of the support 54 directly away from the activation portion 60.

The movable contact 22a is arced and is formed of a conductive material.

The switch 10a is electrically connected to an electrical circuit (not shown), including a power source.

The switch 10a is assembled, after formation of the subassembly of the metal stamping 33a and the base 12a, by placing the movable contact 22a so that its peripheral edge rests on the fixed contacts 24c with the concave surface of the movable contact 22a spaced from and facing the central fixed contact 24b. The bearing portion 62 of the start button 52 is positioned on the arced portion of the movable contact 22 with the peripheral edge of the support 54 overlapping the upper surface of the walls 30b, 30c. The cover portion 18a is positioned on top of the support 54 with the activation portion 60 extending up through the aperture 36a and each of the centrally positioned projection 31 is passed through the opening 35 and engaged by the engagement bar 37 to complete the assembly. If an operator applies pressure to the activation portion 60 of the start button 52, the activation portion 60 will compress slightly and the support 54 will flex and the bearing portion 62 will cause the movable contact 22a to bend engaging the central fixed contact 24b completing an electrical circuit.

In order to assure the switch 10a is sealed against moisture it is dipped in a low viscosity, anaerobically curable sealant such as LOCTITE Resinol RTC manufactured by the Loctite Corporation of Newington, Conn.

What I claim is:

1. A sealed electric switch comprising a base, a retainer, an actuator, a secondary actuator, a movable contact, a central fixed contact, a pair of fixed contacts and terminals connected to said pair of fixed contacts; the base, includes a base portion having a plurality of peripheral edges including two opposite edges and having an upper surface, a wall extending from each peripheral edge, the two opposite walls includes a centrally positioned projection and a top edge, the actuator positioned in superposed relation to the secondary actuator, the retainer comprises a top portion having a wing extending integrally from two opposite sides thereof and an aperture formed centrally there through, each of the wings includes a centrally positioned, rectangular through opening whose lower side provides an engagement bar, the secondary actuator comprises a plastic support portion which is centered in a disk, the support portion includes an upper surface, a side surface and a lower surface, the disk having an upper face and a lower face, the upper surface lying on a different plane than the lower face and the disk extends integrally from the side surface, the movable contact is formed of a flexible current carrying material, has a concave surface defining an arced portion, and has a perimeter edge, the central fixed contact being centrally positioned over the upper surface of the base portion and the pair of fixed contacts being positioned on the upper surface of the base portion, in spaced relation to each other, and in bracketing spaced relation to the central fixed contact, the movable contact being located with its perimeter edge abutting the fixed contacts and its concave surface spaced from and facing the central fixed contact, the support portion of the secondary actuator is positioned on the arced portion of the movable contact with the peripheral edge of the disk in close proximity to the inside surface of the opposite walls, a substantially impermeable film abuts the upper surface of the support portion and covers top edges of at least two walls, the retainer is placed on top of the film and each of the centrally positioned projections is passed through the rectangular through opening of the retainer and engaged by the engagement bar, to complete the assembly.

2. A sealed electric switch comprising a base, including a base portion having walls extending upwardly therefrom to form an opening; an actuator, a cover portion, a movable contact, a central fixed contact, a pair of fixed contacts and terminals connected to said pair of fixed contacts, the actuator comprises a support portion which is centered in a disk, the support portion includes an upper surface; a side surface and a lower surface, the disk having an upper face and a lower face, the upper surface lying on a different plane than the lower face and the disk extends integrally from the side surface, the cover portion having side edges and an aperture formed there through, the aperture in coaxial relation to the opening, the cover portion in superimposed relation to the base and the actuator, the actuator positioned above the base and partially within the aperture, the movable contact formed of a conductive material, being dish shaped having a peripheral edge and an arced portion, positioned within the base and under the actuator, the central fixed contact and the fixed contacts mounted on the base portion in spaced relation to each other, the peripheral edge of the movable contact bearing against the fixed contacts, the arced portion of the movable contact spaced from the central fixed contact, whereby movement of the actuator against the movable contact causing the movable contact to bear against the central fixed contact completing an electric circuit.

3. A sealed electric switch comprising a base, a start button, a cover portion, a movable contact, a central fixed contact, a pair of fixed contacts and terminals connected to said pair of fixed contacts; the cover portion comprising a top portion, the top portion having two opposite sides, a wing extending integrally from each of the two opposite sides and an aperture formed through the top portion, each of the wings including a through opening, the though opening having a lower side, the lower side providing an engagement bar, the cover portion in superimposed relation to the base and to the start button, the start button comprises a support portion which is centered in a disk, and the disk circumscribes the support portion, the support portion includes an upper surface; a side surface and a lower surface, the disk having an upper face and a lower face, the upper surface lying on a different plane than the lower face and the disk extends integrally from the side surface, the start button in superimposed relation to the base, the base including a base portion having walls extending upward therefrom forming a box like structure, the walls having top edges, the walls including a pair of second walls in spaced, opposed relation to each other, each of the second walls having an external surface, each of the second walls including a projection extending from the external surface, the support positioned on the top edges under the cover portion, the start button in superimposed, abutting relation to the movable contact, the movable contact formed of an electrically conductive material, being dish shaped having a peripheral edge and an arced portion, positioned within the base and under the start button, the central fixed contact and the fixed contacts mounted on the base portion in spaced relation to each other, the peripheral edge of the movable contact bearing against the fixed contacts, the arced portion of the movable contact spaced from the central fixed contact, each of the projections passed through a respective through opening and engaged by the engagement bar, whereby movement of the start button against the movable contact causing the movable contact to bear against the central fixed contact completing an electric circuit.

* * * * *